US007003882B2

(12) United States Patent
Sakai

(10) Patent No.: US 7,003,882 B2
(45) Date of Patent: Feb. 28, 2006

(54) NAIL CLIPPER

(76) Inventor: Mitsuaki Sakai, 897-11, Nakano, Tsukuimachi, Tsukui-gun, Kanagawa 220-0207 (JP)

( * ) Notice: Subject to any disclaimer, the term of this patent is extended or adjusted under 35 U.S.C. 154(b) by 58 days.

(21) Appl. No.: 10/792,595

(22) Filed: Mar. 3, 2004

(65) Prior Publication Data

US 2004/0200073 A1 Oct. 14, 2004

(30) Foreign Application Priority Data

Apr. 14, 2003 (JP) ..... 2003-109101

(51) Int. Cl.
*A45D 29/02* (2006.01)

(52) U.S. Cl. ..... 30/26; 30/28; 30/29

(58) Field of Classification Search ..... 30/175, 30/186, 173, 194, 278, 279.2, 341, 28, 29, 30/26

See application file for complete search history.

(56) References Cited

U.S. PATENT DOCUMENTS 340,212 A * 4/1886 Heath et al. ..... 30/113
2,540,782 A * 2/1951 Hansen ..... 30/27
4,644,644 A * 2/1987 Elsholz ..... 30/28
5,384,960 A * 1/1995 Tottenham ..... 30/28
5,622,191 A 4/1997 McMullen, Jr. et al.
5,640,770 A 6/1997 Fowler
5,727,318 A 3/1998 Reiswig
6,557,259 B1 * 5/2003 Nguyen ..... 30/29
6,860,017 B1 * 3/2005 Mennicken ..... 30/261

FOREIGN PATENT DOCUMENTS

FR 2700251 A1 7/1994

* cited by examiner

*Primary Examiner*—Allan N. Shoap
*Assistant Examiner*—Omar Flores Sánchez

(57) ABSTRACT

A nail clipper 10 includes a fixed blade member 2 and a movable blade member 3. The fixed blade member 2 in a form of a curved plate has a curved face for enabling a finger tip F to be contacted with the curved face, a nail insertion groove 23 in an arc shape which is formed in this curved face, and a cutting edge 24 which is provided at a backward lower edge of the nail insertion groove 23. The movable blade member 3 has a curved face 33 so as to slide up and down along a back face of the fixed blade member 2, and a cutting edge 34 which is formed at a lower edge of the curved face 33 in a curved shape in correspondence with the above mentioned cutting edge 24. When the movable blade member 3 has slid downward, the cutting edge 34 is adapted to cut a part of a nail n which is protruded from the nail insertion groove 23.

7 Claims, 3 Drawing Sheets

NAIL CLIPPER

BACKGROUND OF THE INVENTION

1. Field of the Invention

The present invention relates to a nail clipper, and more particularly, to the nail clipper which can be easily used even by a visually handicapped person, and can safely and reliably cut nails without cutting too deep, in a dark condition or in case of cutting nails of a child.

2. Description of the Related Art

A generally known nail clipper of a conventional type includes two levers which are connected at their backward ends to be usually kept open in a bifurcate shape. Respective tip ends of the levers are bent in an L shape to form nail cutting portions which are opposed to each other. The nail cutting portions are curved in a concave shape and provided with nail cutting edges at respective tip ends of the nail cutting portions. One (a lower one) of the levers has a support pole uprightly provided thereon, and a forward end of a depressing lever is pivotally held on the support pole. By operating the depressing lever, the other lever is resiliently closed by an action of leverage by way of a cam mechanism provided on the depressing lever, thereby to press and cut a nail between the above mentioned upper and lower nail cutting edges. Moreover, there have been some nail clippers of a type that a scatter preventing cover is attached to side faces of one or both the levers, in order to prevent nail chips which have been cut from scattering.

In the conventional nail clipper as described above, the nail cutting edges are horizontally formed. However, there has been proposed such a nail clipper that the nail cutting edges are curved so as to correspond with a curvature of an upper face of the nail, as disclosed in Japanese publication of the registered Utility Model No. 3075179.

The conventional nail clipper has been so constructed, as described above, that the nail can be cut by depressing the depressing lever in a state where the nail tip is inserted between the upper and lower nail cutting edges. Therefore, on occasion of using the conventional nail clipper, it has been necessary to position the nail clipper while visually confirming a length of the nail to be cut, and it has been extremely difficult for a visually handicapped person to use the conventional nail clipper.

Moreover, since the upper and lower nail cutting edges are kept open widely in the conventional nail clipper, there has been such an anxiety that even a flesh part of a finger tip may be inserted between the nail cutting edges, and in case where the nail clipper has been used in a dark condition or in case of cutting nails of a child, the nails may be cut too deep or the flesh part of the finger tip may be injured.

An object of the invention is to overcome such drawbacks of the conventional nail clipper, and to provide a nail clipper which can be easily used even by a visually handicapped person, and can safely and reliably cut nails without cutting too deep, even in a dark condition and in case of cutting nails of a child.

SUMMARY OF THE INVENTION

In order to attain the above described object, there is provided according to the present invention, a nail clipper comprising a fixed blade member in a shape of a curved plate including a curved face which is formed in a concave shape for enabling a finger tip to be contacted therewith, a nail insertion groove in an arc shape which is formed in the curved face, and a cutting edge which is provided at a backward lower edge of the nail insertion groove, and a movable blade member including a curved face which is formed so that the movable blade member can slide up and down along a back face of the fixed blade member, and a cutting edge provided at a lower edge of the curved face and having a curved shape in correspondence with the cutting edge of the fixed blade member, characterized in that the movable blade member is slid downward thereby to cut a part of the nail which is protruded from the nail insertion groove, in cooperation with the fixed blade member.

In this case, according to a further aspect of the present invention, the fixed blade member is mounted on a nail clipper body which is provided with a first operating arm, and the movable blade member is mounted on the nail clipper body so as to slidably move up and down, the nail clipper further including a second operating arm which is pivotally fixed to the nail clipper body at its forward end and arranged so as to be opposed to the first operating arm for making the movable blade member slide downward, and spring means for usually urging the movable blade member in a direction of moving upward.

On occasion of using the nail clipper having the above described structure, the finger tip is slid along the curved face of the fixed blade member to arrive at the nail insertion groove, and the nail tip is inserted into the nail insertion groove, whereby only the part of the nail to be cut can be protruded inwardly from the nail insertion groove. By depressing the first and second operating arms in this state to each other so as to be closed, the movable blade member will be depressed by the second operating arm, and the part of the nail protruded from the nail insertion groove can be reliably cut by the cooperation of the cutting edge of the fixed blade member and the cutting edge of the movable blade member.

Because the nail clipper in this invention is constructed in such a manner that the finger tip can be slid along the curved face of the fixed blade member to arrive at the nail insertion groove, for enabling the nail tip to be inserted into the nail insertion groove, even the visually handicapped person can easily operate the nail clipper. Further, the nail clipper can be extremely safely used, because only the part of the nail to be cut is protruded from the nail insertion groove.

Preferably, the fixed blade member is detachably mounted on the nail clipper body, although the fixed blade member may be fixed to the nail clipper body. By designing the fixed blade member as a separate component in this manner, it is easy to manufacture the blade member, and at the same time, it is possible to exchange the fixed blade member. Accordingly, the fixed blade member can be exchanged when the cutting edge has lost its sharpness. Besides, a plurality of the fixed blade members formed of sheet metals having different thickness may be prepared in advance, and by exchanging these fixed blade members, a length of the nail to be cut can be selected.

Moreover, in the nail clipper according to the invention, a nail chip reservoir having an opening for disposal may be provided inside the nail clipper body. By providing this nail chip reservoir in this manner, the nail chips can be prevented from scattering.

According to a further aspect of the invention, the cutting edge of the movable blade member is slightly inclined with respect to the cutting edge of the fixed blade member, whereby the nail is sequentially cut from one end to the other end of the cutting edge of the fixed blade member by a downward movement of the movable blade member. As the results, the above mentioned second operating arm can be operated with a small depressing force.

According to a still further aspect of the invention, a slanted face is formed at an opening edge of the nail insertion groove from a lower edge of an inlet up to the cutting edge at the backward end, whereby the nail insertion groove is substantially made narrow at the backward end. By designing the nail insertion groove in this manner, the finger tip is guided along the slanted face, and the part of the nail to be cut will be protruded backward from the nail insertion groove without being affected by thickness of the fixed blade member, and can be reliably cut.

Preferably, the first operating arm and the second operating arm are provided with ring-like portions to be secured by inserting a user's fingers, at their respective backward end parts. As the results, it is possible to operate the nail clipper according to the invention in a manner of operating a pair of scissors.

DESCRIPTION OF THE PREFERRED EMBODIMENT

Figure 1:
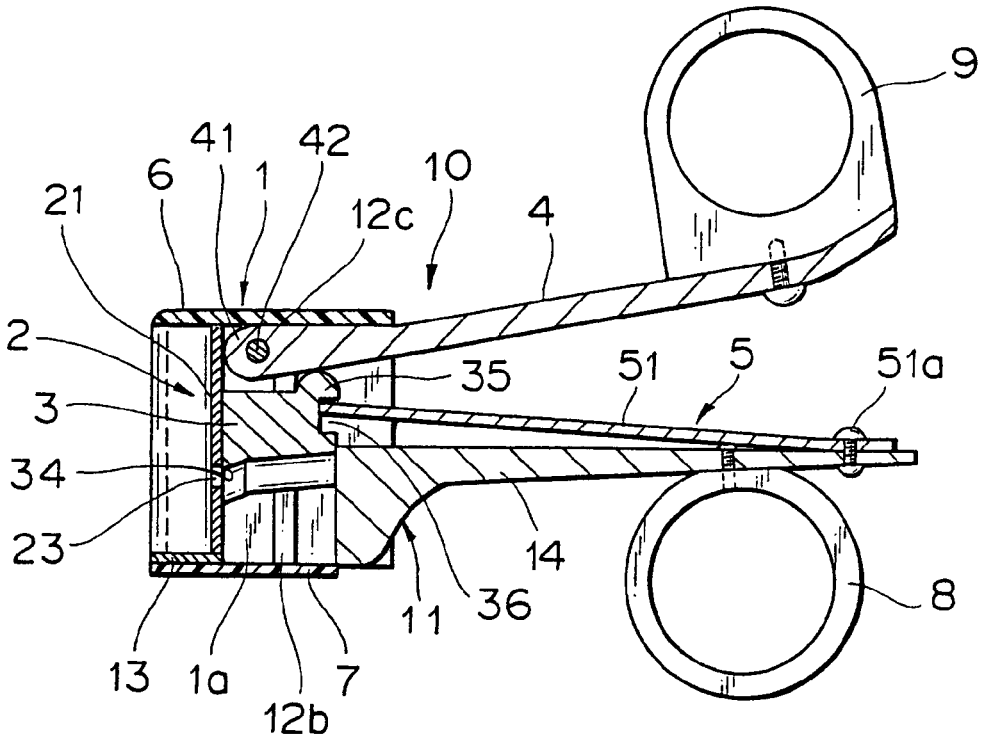
FIG. 1 is a sectional view of a nail clipper according to the present invention.

Now, a preferred embodiment of the nail clipper according to the present invention will be described referring to the drawings.

Figure 2:
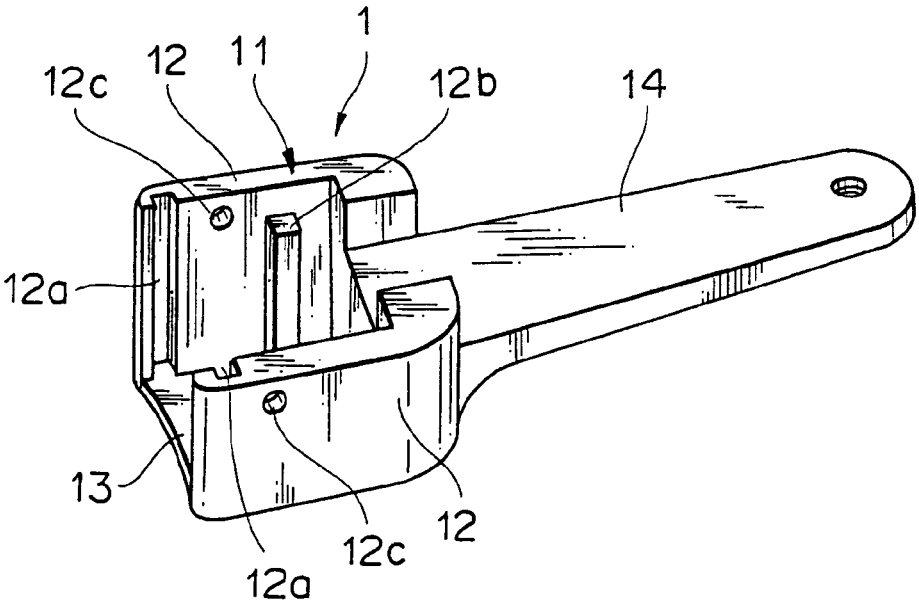
FIG. 2 is a perspective view of a nail clipper body.
Figure 5:
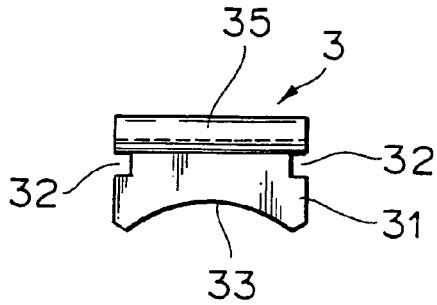
FIG. 5 is a plan view of the movable blade member.
Figure 4:
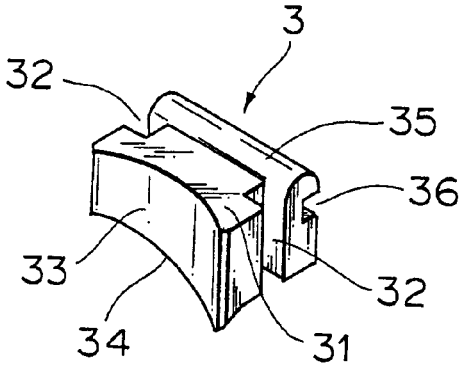
FIG. 4 is a perspective view of a movable blade member.
Figure 6:
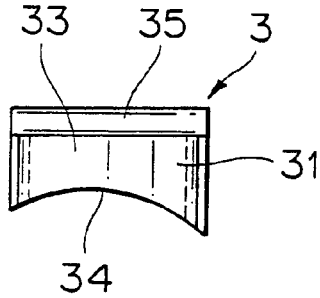
FIG. 6 is a front view of the movable blade member.
Figure 7:
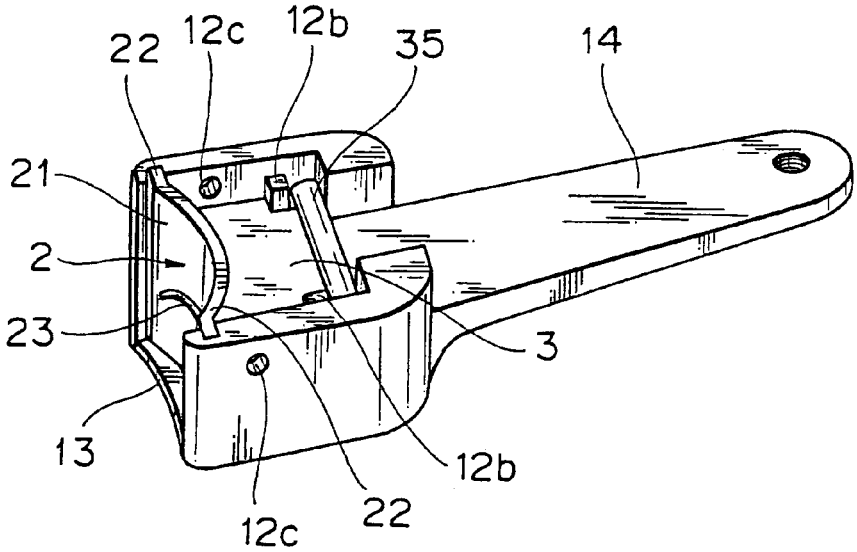
FIG. 7 is a perspective view of the nail clipper body having the fixed blade member and the movable blade member assembled thereto.

FIG. 1 shows the nail clipper 10 which includes a fixed blade member 2 and a movable blade member 3. As shown in FIG. 2, the fixed blade member 2 is in a form of a curved plate, and has a curved face in a concave shape for enabling a finger tip F to be contacted with the curved face (See FIG. 12), a nail insertion groove 23 in an arc shape which is formed in this curved face, and a cutting edge 24 which is provided at a backward lower edge of the nail insertion groove 23 (See FIG. 11). As shown in FIGS. 4 to 6, the movable blade member 3 has a curved face 33 which is formed so that the movable blade member can slide up and down along a back face of the fixed blade member 2, and a cutting edge 34 formed at a lower edge of the curved face 33 and having a curved shape in correspondence with the above mentioned cutting edge 24. The movable blade member 3 is adapted to cut a nail portion n (See FIG. 12) which is protruded from the nail insertion groove 23, by sliding downward, in cooperation with the fixed blade member 2. In FIG. 1, the nail clipper 10 is shown in a state where the movable blade member 3 has been rather depressed.

The fixed blade member 2 is detachably mounted on a nail clipper body 1 which is provided with an operating arm 14, and the movable blade member 3 is mounted on the nail clipper body 1 so as to slidably move up and down. In order to make the movable blade member 3 slide downward, another operating arm 4 is provided on the nail clipper body 1 in such a manner that its one end 41 is pivotally supported about a pivot pin 42 in a manner opposed to the above mentioned operating arm 14, and spring means 5 is provided for the purpose of usually urging the movable blade member in a direction of moving upward.

To describe the structure of the nail clipper body more specifically referring to FIG. 2, the nail clipper body 1 includes a frame-like portion 11 provided with right and left side walls 12, 12, and the above mentioned operating arm 14 which is extended from a backward end of the frame-like portion 11. A front part and a top part of the frame-like portion 11 are open, and a stopper 13 for supporting the fixed blade member 2 which has been mounted from the above is formed in a front half area of a lower face. A backward half area of the lower face is open.

The right and left side walls 12, 12 are respectively provided with guide grooves 12*a*, 12*a* at forward end areas of their inner faces in a manner opposed to each other, and the fixed blade member 2 is adapted to be inserted into these guide grooves 12*a*, 12*a*. Behind the guide grooves 12*a*, 12*a*, there are provided vertical guide ribs 12*b*, 12*b* for guiding the movable blade member 3 so as to move up and down.

Figure 3:
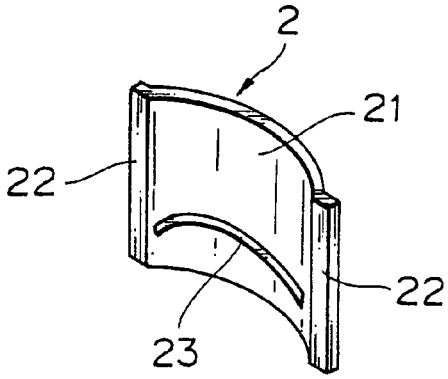
FIG. 3 is a perspective view of a fixed blade member.

Referring to FIG. 3, the fixed blade member 2 has a curved plate portion 21 which is made of steel and provided with thick-walled support portions 22, 22 of a size corresponding to a width of the aforesaid guide grooves 12*a*, 12*a* of the frame-like portion 11, at both side ends of the curved plate portion 21. A curved face of the curved plate portion 21 has such a curvature as substantially corresponding to a tip end of a pollex of a foot. The curved plate portion 21 is provided with the nail insertion groove 23 in an upwardly curved shape, and the cutting edge 24 is formed at the lower edge of the backward end of the nail insertion groove, as described above.

Figure 11:
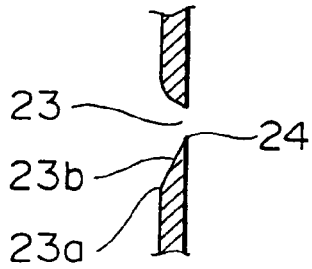
FIG. 11 is an enlarged sectional view of a nail insertion groove.
Figure 12:
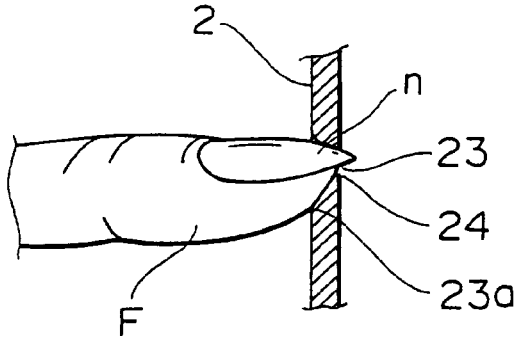
FIG. 12 is an enlarged sectional view showing a nail tip inserted into the nail insertion groove.

As shown in an enlarged sectional view in FIG. 11, a slanted face 23*b* is formed at an opening edge of the nail insertion groove 23 from a lower edge 23*a* at an inlet up to the cutting edge 24 at the backward end so that the backward end of the nail insertion groove 23 may be substantially made narrow. Accordingly, the finger tip F will be slid along the slanted face 23*b* as shown in FIG. 12, and only a part of the nail n to be cut will protrude backward from the nail insertion groove 23 without being affected by the thickness of the fixed blade member 2, thereby to be reliably cut. Desirably, an upper edge of the inlet of the nail insertion groove 23 may be rounded.

A plurality of the fixed blade members 2 having the same thickness of the support portions 22 but having different thickness of the curved plate portion 21 can be provided in advance, and by appropriately selecting the fixed blade member 2 to be used, it is possible to set a length (depth) of the nail tip to be cut. A nail polishing file may be further provided in a part of the curved plate portion 21 of the fixed blade member 2 or a side face of the frame-like portion 11 of the nail clipper body 1.

Referring to FIG. 4, the movable blade member 3 is in a form of a block body 31 in a rectangular shape which is made of steel, and has the curved face 33 on a front face of the block body 31 so that the movable blade member can slide up and down along the back face of the curved plate portion 21 of the fixed blade member 2. The cutting edge 34 having a curved shape in correspondence with the above mentioned cutting edge 24 of the fixed blade member 2 is formed at a lower edge of the curved face 33. The block body 31 has, at both sides of a backward part thereof, slide guide grooves 32, 32 which are adapted to receive the guide ribs 12*b*, 12*b* of the nail clipper body 1. By assembling the movable blade member 3 while the guide ribs 12*b*, 12*b* are engaged with the slide guide grooves 32, 32, the movable blade member 3 can move up and down inside the nail clipper body 1.

The block body 31 is provided on its backward upper face with a bolster portion 35 which the other operating arm 4 is adapted to be contacted and engaged with, and at the same time, an engaging groove 36 is formed on a backward end face of the block body 31 so that a forward end of a leaf spring 51 acting as the aforesaid spring means 5 may be engaged with the engaging groove 36.

Figure 10:
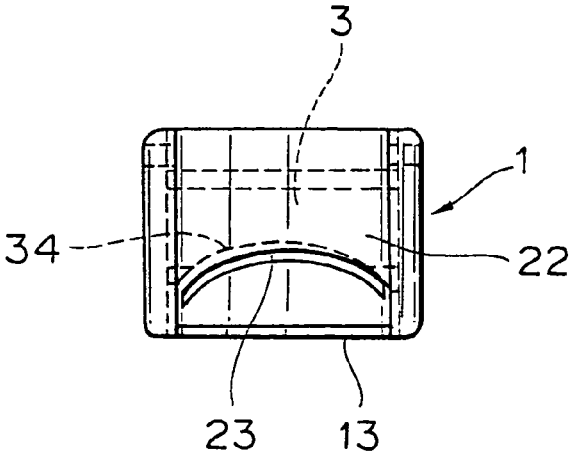
FIG. 10 is a front view of the nail clipper body showing in a perspective way a state in which a cutting edge of the movable blade member is slightly inclined with respect to a cutting edge of the fixed blade member.

The cutting edge 34 of the movable blade member 3 does not draw the same arc as the cutting edge 24 of the fixed blade member 2, but is formed to be slightly inclined with respect to the cutting edge 24 of the fixed blade member 2, as shown in FIGS. 6 and 10. This enables the nail to be cut sequentially from one end to the other end of the cutting edge 24 of the fixed blade member 2, when the movable blade member 3 has moved down to cut the nail between the cutting edge 34 and the cutting edge 24 of the fixed blade member 2. Therefore, on occasion of cutting the nail, the other operating arm 4 for moving the movable blade member 3 downward can be operated with a small depressing force.

As shown in FIG. 1, the other operating arm 4 is pivotally engaged, at its forward end part, with the frame-like portion 11 of the nail clipper body 1 by means of a pivot pin 41, and kept in contact with the bolster portion 35 of the movable blade member 3. By depressing down the other operating arm 4, the movable blade member 3 can be resiliently pushed down.

As the spring means 5 for usually keeping the movable blade member 3 in an elevated position, the leaf spring 51 is engaged with the engaging groove 36 of the movable blade member 3 at its forward end, and at the same time, fixed to the one operating arm 14 at its backward end. This structure permits the movable blade member 3 to be resiliently held so that it may be always urged in a direction of moving upward, and can slide in a direction of moving downward.

Figure 8:
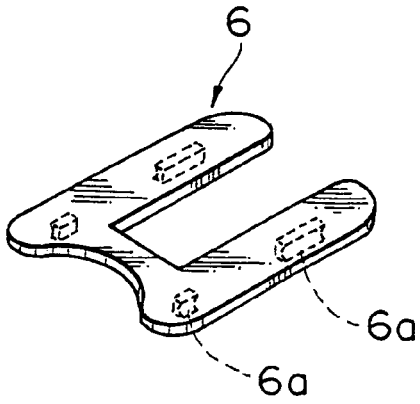
FIG. 8 is a perspective view of an upper cover.
Figure 9:
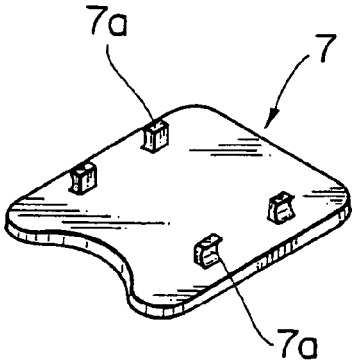
FIG. 9 is a perspective view of a bottom cover.

Designated by reference numeral 6 is an upper cover which is detachably fitted over an upper face of the nail clipper body 1. The upper cover 6 is formed of rubber or synthetic resin, and as shown in FIG. 8, may be provided with engaging hooks 6*a* which are adapted to be engaged with the inner wall of the frame-like portion 11, on its lower face, thereby to be fitted over an opening in the upper face of the nail clipper body 1. Designated by reference numeral 7 is a bottom cover which is provided on a bottom face of the nail clipper body 1. As shown in FIG. 1, a nail chip reservoir 1*a* may be defined inside the nail clipper body 1 by this bottom cover 7, and by removing the bottom cover 7, nail chips kept in the nail chip reservoir 1*a* can be disposed. The bottom cover 7 is formed of rubber or synthetic resin in the same manner as the upper cover 6, and as shown in FIG. 9, may be provided with engaging hooks 7*a* which are adapted to be engaged with the inner wall of the frame-like portion 11, on its upper face, thereby to be fitted to an opening in the lower face of the nail clipper body. Alternatively, a thin-walled hinge portion may be formed at an appropriate position so that a part of the bottom cover can be opened or closed.

The above described one operating arm 14 and the other operating arm 4 may be so designed that the backward ends thereof may be simply depressed, in the same manner as in the conventional nail clipper. In this embodiment however, in order to facilitate the operation, ring-like portions 8, 9 to be secured by inserting a user's fingers are respectively provided at backward ends of the one operating arm 14 and the other operating arm 4. Although these ring-like portions 8, 9 are molded of synthetic resin as separate members, and are fixed to the operating arms 14, 4 by screws in this embodiment, alternatively, the respective backward ends of the operating arms 14, 4 may be formed longer, and maybe folded into a ring-like shape.

In order to assemble the nail clipper having the above described structure, the fixed blade member 2 is inserted into the frame-like portion 11 from the above, in such a manner that the support portions 22 of the fixed blade member 2 may be engaged in the guide grooves 12*a* of the frame-like portion 11. Then, the movable blade member 3 is inserted into the frame-like portion 11 from the above or below in such a manner that the slide guide grooves 32 may be engaged with the guide ribs 12*b* of the frame-like portion 11. Thereafter, the forward end of the leaf spring 51 is engaged in the engaging groove 36 of the movable blade member 3 to be secured, and the backward end of the leaf spring 51 is fixed to the backward end of the one operating arm 14 by a screw 51*a*. In this manner, the movable blade member 3 will be resiliently held.

Then, the forward end 41 of the other operating arm 4 is pivotally secured by means of the pivot pin 42 which is received in the pivot holes 12*c* in the side walls 12 of the frame-like portion 11 so as to freely rotate. Then, by fitting the upper cover 6 and the bottom cover 7 over the openings in the upper and lower faces of the frame-like portion 11, the assembling work will be completed.

In case where the backward end of the leaf spring 51 is so designed as to be fixed to the backward end of the one operating arm 14 by the screw 51*a*, as described above, the leaf spring 51 can be easily detached, and the movable blade member 3 can be exchanged. Moreover, the screw 51*a* may be used also as the screw for fixing the ring-like portion 8 to the one operating arm 14.

When the nail clipper 10 having the above described structure is actually used, the finger tip F is slid from the above along the curved face of the fixed blade member 2 to arrive at the nail insertion groove 23, and the nail tip is inserted into the nail insertion groove 23, whereby only the part of the nail to be cut can be protruded backward from the nail insertion groove 23. By depressing the one and the other operating arms 14, 4 in this state onto each other so as to be closed, the movable blade member 3 will be depressed with the other operating arm 4, whereby the part of the nail protruded from the nail insertion groove 23 can be reliably cut by the cooperation of the cutting edge 24 of the fixed blade member 2 and the cutting edge 34 of the movable blade member 3. The curved face of the fixed blade member 2 does not have such a curvature as to correspond with the shapes of all the finger tips, and so, it is necessary to cut the nail while the finger tip is sequentially turned in a horizontal direction.

Because the nail clipper according to the invention is constructed in such a manner that the finger tip F is slid along the curved face of the fixed blade member 2 to arrive at the nail insertion groove 23, and the nail tip is inserted into the nail insertion groove 23, even a visually handicapped person can easily operate the nail clipper. Further, the nail clipper can be extremely safely used, because only the part of the nail to be cut is protruded from the nail insertion groove 23 and then cut.

Although the present invention has been fully described by way of an example with reference to the accompanying drawings, it is to be noted that various changes and modification can be made within a scope of the present invention.

What is claimed is:

1. A nail clipper comprising:

a fixed blade member in a shape of a curved plate including a curved face which is formed in a concave shape for enabling a finger tip to be contacted therewith, a nail insertion groove in an arc shape which is formed in said curved face, and a cutting edge which is provided at a backward lower edge of said nail insertion groove, a movable blade member including a curved face which is formed so that said movable blade member can slide up and down along a back face of said fixed blade member, and a cutting edge provided at a lower edge of said curved face and having a curved shape in correspondence with said cutting edge of the fixed blade member, wherein said movable blade member is slid downward thereby to cut a part of a nail which is protruded from said nail insertion groove, in cooperation with said fixed blade member, wherein said fixed blade member is mounted on a nail clipper body which is provided with a first operating arm, and said movable blade member is mounted on said nail clipper body so as to slidably move up and down, said nail clipper further including a second operating arm which is pivotally fixed to said nail clipper body at its forward end and arranged in a manner opposed to said first operating arm for making the movable blade member slide downward, and spring means for usually urging said movable blade member in a direction of moving upward, further including a leaf spring that has opposed ends and acts at one end on one of the operating arms and wherein said movable blade member includes an engaging groove that is engaged by the other end of the leaf spring.

2. The nail clipper as claimed in claim 1, wherein said fixed blade member is detachably mounted on said nail clipper body.

3. The nail clipper as claimed in claim 1, wherein a nail chip reservoir having an opening for disposal is provided inside the nail clipper body.

4. The nail clipper as claimed in any one of claim 1, wherein said cutting edge of the movable blade member is slightly inclined with respect to the cutting edge of the fixed blade member, whereby the nail is sequentially cut from one end to the other end of the cutting edge of the fixed blade member by a downward movement of the movable blade member.

5. The nail clipper as claimed in any of claim 1, wherein a slanted face is formed at an opening edge of said nail insertion groove from a lower edge of an inlet up to said cutting edge at the backward end, whereby the nail insertion groove is substantially made narrow at the backward end.

6. The nail clipper as claimed in any one of claim 1, wherein said first operating arm and said second operating arm are provided with ring-like portions to be secured by inserting fingers at their respective backward end parts.

7. The nail clipper as claimed in any one of claim 1, wherein said second operating arm moves generally up and down in the same direction of movement of the movable blade member.

* * * * *